US009004300B1

(12) United States Patent
Morrell

(10) Patent No.: US 9,004,300 B1
(45) Date of Patent: Apr. 14, 2015

(54) DISPLAY RACK WITH MULTI-POSITION SHELVES

(71) Applicant: Chicago Display Company, River Grove, IL (US)

(72) Inventor: Jordan Morrell, Chicago, IL (US)

(73) Assignee: Chicago Display Company, River Grove, IL (US)

( * ) Notice: Subject to any disclaimer, the term of this patent is extended or adjusted under 35 U.S.C. 154(b) by 0 days.

(21) Appl. No.: 14/084,273

(22) Filed: Nov. 19, 2013

(51) Int. Cl.

| | |
|---|---|
| ***A47B 43/00*** | (2006.01) |
| ***A47F 5/00*** | (2006.01) |
| *A47F 5/12* | (2006.01) |
| *A47B 9/00* | (2006.01) |
| *A47B 91/00* | (2006.01) |
| *A47F 5/08* | (2006.01) |

(52) U.S. Cl.
CPC ..... *A47F 5/0018* (2013.01)

(58) Field of Classification Search
USPC ..... 211/186, 187, 134, 188, 149, 150; 108/6, 106–108, 180, 181, 187, 189; 248/240, 242
See application file for complete search history.

(56) References Cited

U.S. PATENT DOCUMENTS

| | | | |
|---|---|---|---|
| 898,970 | A | 9/1908 | Cook |
| 977,609 | A | 12/1910 | Freeman |
| 1,456,446 | A | 5/1923 | Hotaling |
| 1,962,504 | A | 6/1934 | Hauptli |
| 2,122,833 | A | 7/1938 | Black |
| 2,643,170 | A | 6/1953 | Vanderveld et al. |
| 2,648,442 | A | 8/1953 | Lowmaster |
| 2,676,712 | A | 4/1954 | Chappory |
| 2,739,777 | A | 3/1956 | Schoenhardt |
| 2,802,291 | A | 8/1957 | Bach et al. |
| 2,956,688 | A | 10/1960 | Galassi |

(Continued)

FOREIGN PATENT DOCUMENTS

| | | |
|---|---|---|
| FR | 2641113 A1 | 6/1990 |
| FR | 2679966 A1 | 2/1993 |

OTHER PUBLICATIONS

2013 Southern Imperial, Inc. catalog p. 279 showing Tiered, Stationery, and Full View Wire Racks.

(Continued)

*Primary Examiner* — Joshua J Michener
*Assistant Examiner* — Devin Barnett
(74) *Attorney, Agent, or Firm* — Jansson Munger McKinley & Shape Ltd.

(57) ABSTRACT

A display rack and display rack shelf. The display rack includes a frame which supports one or more of the shelves. The frame has first, second and lateral sides and defines a plurality of vertically-spaced pairs of horizontally-aligned apertures. The shelf includes first and second end portions. The first end portion includes a movable support element with a single piece cross member and a pair of movable engagers at opposite lateral sides of the shelf for engagement with a selected pair of apertures along the first or second sides of the frame. The single-piece cross member and each movable engager of the movable support element is slidable toward and, alternatively, away from the second end and is rotatable about a corresponding axis to permit setting of the angular position of the shelf. The second end portion side is configured for pivotal engagement with one of the front and rear sides of the frame. The shelf of the rack is adjustable for a plurality of angular orientations by a selective positioning of the first end portion with respect to the second end portion.

18 Claims, 14 Drawing Sheets

(56) References Cited

U.S. PATENT DOCUMENTS

| | | | |
|---|---|---|---|
| 3,125,042 | A | 3/1964 | Mapson |
| 3,130,693 | A | 4/1964 | Shell |
| 3,151,576 | A | 10/1964 | Patterson |
| 3,244,127 | A | 4/1966 | Evans |
| 3,487,951 | A | 1/1970 | Beltzung |
| 3,527,359 | A | 9/1970 | Lambertson |
| 3,601,256 | A | 8/1971 | Clement et al. |
| 3,667,617 | A | 6/1972 | Cohn |
| 3,730,108 | A | 5/1973 | Stroh |
| D233,380 | S | 10/1974 | Hyman |
| 3,856,148 | A | 12/1974 | Olinick |
| 3,856,320 | A | 12/1974 | Blanchard |
| 3,915,097 | A | 10/1975 | Young |
| 3,986,758 | A | 10/1976 | Heaney |
| D243,891 | S | 4/1977 | Snyder |
| 4,055,253 | A | 10/1977 | Oztekin |
| D246,773 | S | 12/1977 | Bladis |
| 4,063,518 | A | 12/1977 | Bustos |
| 4,093,077 | A | 6/1978 | Strasser |
| 4,108,085 | A | 8/1978 | Shepherd |
| 4,139,247 | A | 2/1979 | Karashima |
| 4,231,301 | A | 11/1980 | Barrineau |
| 4,264,113 | A | 4/1981 | Suttles |
| 4,292,902 | A | 10/1981 | Barrineau |
| 4,307,671 | A | 12/1981 | Albano |
| 4,526,110 | A | 7/1985 | Franz |
| 4,593,823 | A | 6/1986 | Fershko et al. |
| D288,640 | S | 3/1987 | Campbell |
| 4,756,430 | A | 7/1988 | Spamer et al. |
| 4,809,855 | A | 3/1989 | Bustos |
| 4,850,285 | A | 7/1989 | Suttles |
| 4,872,567 | A | 10/1989 | Bustos |
| 4,890,374 | A | 1/1990 | Messick |
| 4,934,645 | A | 6/1990 | Breslow |
| 4,960,210 | A | 10/1990 | Spamer |
| 5,014,862 | A | 5/1991 | Bustos |
| 5,022,720 | A | 6/1991 | Fevig et al. |
| 5,088,607 | A | 2/1992 | Risafi et al. |
| 5,160,051 | A | 11/1992 | Bustos |
| 5,265,740 | A | 11/1993 | Hodsden et al. |
| 5,328,039 | A | 7/1994 | Heimendinger |
| 5,333,746 | A | 8/1994 | Bustos et al. |
| 5,347,922 | A | 9/1994 | Metcalf |
| 5,365,860 | A | 11/1994 | Billington |
| 5,383,562 | A | 1/1995 | Gay et al. |
| 5,433,327 | A | 7/1995 | Benvenuti et al. |
| 5,450,971 | A | 9/1995 | Boron et al. |
| 5,477,789 | A | 12/1995 | Von Gunten |
| 5,477,970 | A | 12/1995 | Watt et al. |
| 5,487,474 | A | 1/1996 | Heimendinger |
| 5,490,600 | A | 2/1996 | Bustos et al. |
| D373,913 | S | 9/1996 | Wyatt et al. |
| 5,577,623 | A | 11/1996 | Bustos et al. |
| 5,645,182 | A | 7/1997 | Miller et al. |
| 5,718,441 | A | 2/1998 | Kern et al. |
| 5,797,502 | A | 8/1998 | Brady et al. |
| D428,282 | S | 7/2000 | Smith |
| 6,095,347 | A | 8/2000 | Mauro-Vetter |
| D430,432 | S | 9/2000 | Mason |
| 6,116,436 | A | 9/2000 | Ferrucci et al. |
| D435,743 | S | 1/2001 | Glauth et al. |
| 6,273,276 | B1 | 8/2001 | Upton et al. |
| 6,332,547 | B1 | 12/2001 | Shaw et al. |
| 6,357,609 | B1 | 3/2002 | Van Noord |
| D478,739 | S | 8/2003 | Sparkowski |
| 6,607,083 | B1 | 8/2003 | Webb |
| D485,450 | S | 1/2004 | Smith |
| 6,729,484 | B2 | 5/2004 | Sparkowski |
| D497,738 | S | 11/2004 | Sparkowski |
| D500,419 | S | 1/2005 | Sparkowski |
| 6,837,387 | B2 | 1/2005 | De La Fuente |
| 6,918,498 | B2 | 7/2005 | Sparkowski |
| D520,265 | S | 5/2006 | Sparkowski |
| D526,818 | S | 8/2006 | Sparkowski |
| 8,127,948 | B2 | 3/2012 | Davis et al. |
| D673,390 | S | 1/2013 | Sparkowski et al. |
| 2006/0273056 | A1 | 12/2006 | Smits et al. |
| 2007/0029273 | A1 | 2/2007 | Dean |
| 2010/0108624 | A1 | 5/2010 | Sparkowski |
| 2011/0278245 | A1 | 11/2011 | Noble Colin |
| 2011/0284485 | A1 | 11/2011 | Sparkowski |
| 2012/0097629 | A1 | 4/2012 | Brisendine |

OTHER PUBLICATIONS

Palay Display webpage showing Adjustable 5-Tier Wire Shelf Rack; retrieved from the Internet on May 15, 2013; URL: http://www.palaydisplay.com/Adjustable-5-Tier-Wire-Shelf-Rack-p-20593.html.

Palay Display webpage showing Angled Pegboard Hooks and J Pegboard Hooks; retrieved from the Internet on May 15, 2013; URL: http://www.palaydisplay.com/Angled-Pegboard-Hooks-and-J-Pegboard-Hooks-p-1-c-769 . . . .

HardwareAndTools.com webpage showing Display Racks, Shelves, Hooks & Holders retrieved from the Internet on May 15, 2013; URL: http://www.hardwareandtools.com/Display-Racks-Shelves-Hooks-and-Holders/.

DISPLAY RACK WITH MULTI-POSITION SHELVES

FIELD

The invention relates to display racks for supporting items in a highly visible and readily accessible manner and, more particularly, to display racks with at least one shelf that can be easily adjusted to different inclined positions for item display.

BACKGROUND

A wide variety of display devices have been designed and manufactured for use in merchandising shelved products to consumers. There are several major disadvantages of prior racks with adjustable shelving. In some of such prior racks, the act of adjusting of the shelves is a complicated manipulation of multiple rack and/or shelf parts; this may result in erroneous shelf adjustment causing the shelves to be insufficiently stable. In some other prior rack arrangements, shelf adjustment may require deformation of shelf and/or rack parts by application of a significant force which may necessitate involvement of multiple people; this creates an undesirable inefficiency and inflexibility in using such racks.

In short, there is a need for a display rack having an adjustable shelf or shelves which can be horizontal or inclined as desired to optimally display one or more item, which is exceptionally simple, economical and sturdy, and in which the shelf or shelves are comparatively-easily lockable into the desired position.

SUMMARY

The present invention is an improvement in display racks with one or more multi-position shelf. In embodiments, the angular position of the shelves and the height of the shelves on the rack can be easily adjusted permitting the user to optimally display items on the rack.

In certain embodiments, the display rack includes a frame and one or more shelf. The shelves may be removable from the frame. The frame has first and second pairs of upright elements. The upright elements define a shelf space and a lateral dimension therebetween and include a plurality of vertically-spaced apertures. The apertures of such upright elements include pairs of apertures at corresponding vertical positions along the upright elements. Each aperture may be substantially round.

In embodiments, a shelf for implementation with the display rack has a principal width at least partially within the shelf space. The shelf includes first and second ends, a first end portion and a second end portion. The first end portion includes a pair of movable engagers for engagement with a pair of apertures of one of the first and second pairs of the upright elements. In the embodiment, the pair of movable engagers are the ends of a single-piece cross-member defining a single axis. The cross-member is rotatable about the single axis and is slidable toward and, alternatively, away from the second end of the shelf. The second end portion includes a pair of nonmovable engagers for engagement with the other of the first and second pair of apertures of the upright elements. This arrangement allows for angular adjustment of a shelf plane by selective positioning of the first end portion with respect to the second end portion. In embodiments, the angular adjustment of the shelf plane can be allowed between about 0° and about 60° with respect to horizontal.

In an embodiment, the vertically-spaced apertures for supporting the pair of movable engagers face the vertically-spaced apertures for supporting the pair of nonmovable engagers. Also in an embodiment, the frame may have first and second sides. The pair of apertures engaged with the movable support may face the second side of the frame and the pair of apertures engaged with the nonmovable support may face the first side of the frame.

An embodiment of a shelf for use with the display rack can have two lateral edge members defining a principal width for the entire shelf. The principal width is preferably less than the lateral dimension of the frame to permit the shelf to fit between the uprights.

In embodiments, both the nonmovable engagers and the movable engagers extend beyond the principal width of the shelf. Each of the movable engagers can rotate in separate substantially-parallel planes substantially orthogonal to the shelf plane. The movable engagers preferably rotate simultaneously when the cross-member rotates.

A shelf embodiment has a plurality of lateral cross elements. The single-piece cross-member in such embodiment is slidable within an adjustment region bounded by a first lateral cross member proximate the first end and a second lateral cross member between the first lateral cross member and the second end. The adjustment region can be about a quarter of the dimension between first and second ends of the shelf.

In embodiments, the single-piece cross-member of the movable engager includes an intermediate portion disposed below the shelf plane and extending therealong to support the shelf with respect to the frame. The intermediate portion defines the single axis. Each of the movable engagers may include a catch outward from the principal width rotatable about the single axis in a plane substantially orthogonal with respect to the shelf plane for engagement with one of the selected apertures. The catch rotation may be limited to about 70°. Each of the nonmovable engagers may project beyond the principal width and terminate in a catch for engagement with a selected one of the apertures.

In an embodiment, each upright element is a hollow tube and each catch rests against an edge of the hollow tube defining the aperture.

In a collapsible embodiment of the display rack, each upright element may be formed by at least two interconnected sections which are separable. The separable elements are useful to minimize dimensions of the rack when disassembled.

In a further embodiment, a display rack comprises a frame and at least one shelf supported by the frame. The shelves may be removable from the frame. In an embodiment of a frame, the frame includes first, second and lateral sides. The sides define a plurality of vertically-spaced first pairs of horizontally-aligned apertures and a plurality of vertically-spaced second pairs of horizontally-aligned apertures. In certain embodiments, the first pairs of horizontally-aligned apertures may face the second pairs of horizontally-aligned apertures.

In embodiments, the frame can include a pair of first upright elements and a pair of second upright elements. In such embodiments, the pair of first upright elements includes the first pairs of horizontally-aligned apertures and the pair of second upright elements includes the second pairs of horizontally-aligned apertures.

In a further embodiment of a shelf for use with display rack, the shelf includes first and second ends, a first end portion including a movable support and a second end portion with a nonmovable support. In embodiments, the movable support is a single-piece cross-member which defines a single axis and which has two ends each including a catch. In the embodiments, the movable support is slidable toward and, alternatively, away from the second end and is rotatable about the single axis such that the catches rotate in separate planes for engagement with a selected one of the first and second pairs of aligned apertures of the frame. In the embodiments, the nonmovable support is for engagement with one of the other of the first and second pairs of aligned apertures of the frame. The display rack allows the user to make angular adjustments of the shelf plane by selectively positioning the first end portion with respect to the second end portion, for example by positioning the first end portion horizontal with the second end portion or by positioning the first end portion above or below the second end portion.

A further aspect of the invention is a shelf for being supported by a display rack frame. The frame of such display rack may have first, second and lateral sides defining a plurality of vertically-spaced pairs of horizontally-aligned apertures. The shelf embodiment includes first and second ends, a first end portion and a second end portion. The first end portion may include a pair of movable engagers at opposite lateral sides of the shelf for engagement with a selected pair of apertures along one of the first and second sides of the frame. In the embodiments, each movable engager is slidable toward and, alternatively, away from the second end and each engager is rotatable about a corresponding single axis extending laterally between the lateral sides of the shelf to facilitate engagement of the engagers with the frame.

In embodiments, the movable engagers are ends of a single-piece cross-member which defines the single laterally-extending axis. In such embodiments, the cross-member is rotatable about the single axis such that the ends and engagers rotate in separate planes for engagement with a selected one of the pairs of aligned apertures of the frame.

The second end portion may be opposite the first end portion and configured for pivotal engagement with the other of the first and second sides of the frame. In embodiments, the second end portion includes a pair of nonmovable engagers each for engagement with a selected pair of apertures of one of the first and second sides of the frame. Such shelf embodiments are adjustable for a plurality of angular orientations by a selective positioning of the first end portion with respect to the second end portion.

BRIEF DESCRIPTION OF THE DRAWINGS

Exemplary display racks, shelves and methods may be understood by reference to the following description taken in conjunction with the accompanying drawings, in which like reference numerals identify like elements throughout the different views. The drawings are not necessarily to scale, emphasis instead being placed upon illustrating the principles of the invention. The drawings depict only embodiments of the invention and are not therefore to be considered as limiting the scope of the invention. In the accompanying drawings.

DETAILED DESCRIPTION

Figure 1:
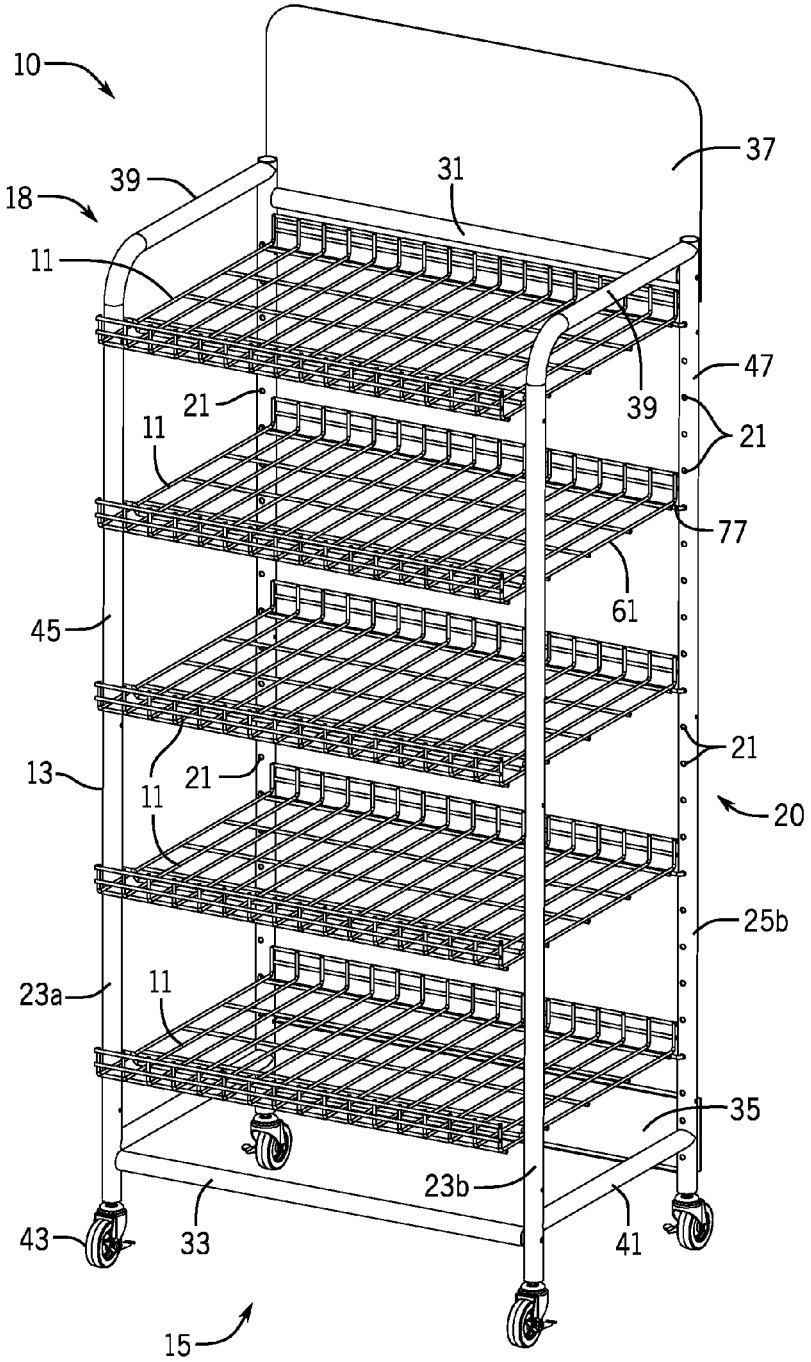
FIG. 1 is a perspective view of an exemplary display rack in accordance with the invention.

Referring first to FIGS. 1-7, there are shown two exemplary embodiments of a display rack 10, 10A, referred to herein simply as a rack. Each rack includes one or more adjustable shelf 11, 11*a*. For convenience and brevity, like components of exemplary racks 10, 10A share the same reference numbers. To avoid obscuring and cluttering of the drawings, just certain of many identical rack components are indicated by reference numbers, it being understood that the component(s) not indicated by the reference number have the same structure and function as the indicated components.

Referring again to FIGS. 1-7, each rack 10, 10A includes a frame 13 having a first, or front, side 15, a second, or rear, side 17 and lateral sides 18, 20. The terms front side and rear side as used herein are non-limiting relative terms used for merely for convenience because an advantage of rack 10, 10A is that rack 10, 10A need not have a specific front or rear side. Rack 10, 10A can be configured so that items can be accessed from either first side 15, second side 17, from both first and second sides 15, 17 or from one or more lateral side 18, 20. A rack 10, 10A with items accessible from both first and second sides 15, 17 would be ideal for placement between two adjacent store aisles with items of merchandise facing customers in each aisle.

As illustrated in FIGS. 1-4, first side 15 of frame 13 defines a first, or front, set of vertically-spaced pairs of horizontally-aligned apertures 19. Second side 17 of frame 13 defines a second, or rear, set of vertically-spaced pairs of horizontally-aligned apertures 21. Certain of such apertures are indicated by reference numbers 19, 21 in FIGS. 1-4. In the examples, each first pair of apertures 19 or second pair of apertures 21 is horizontally aligned in the sense that each pair of first apertures 19 and each set of second apertures 21 is in the same horizontal plane. Aperture pairs 19 and 21 are provided to receive one or more shelf 11, 11*a* as described herein.

Figure 2:
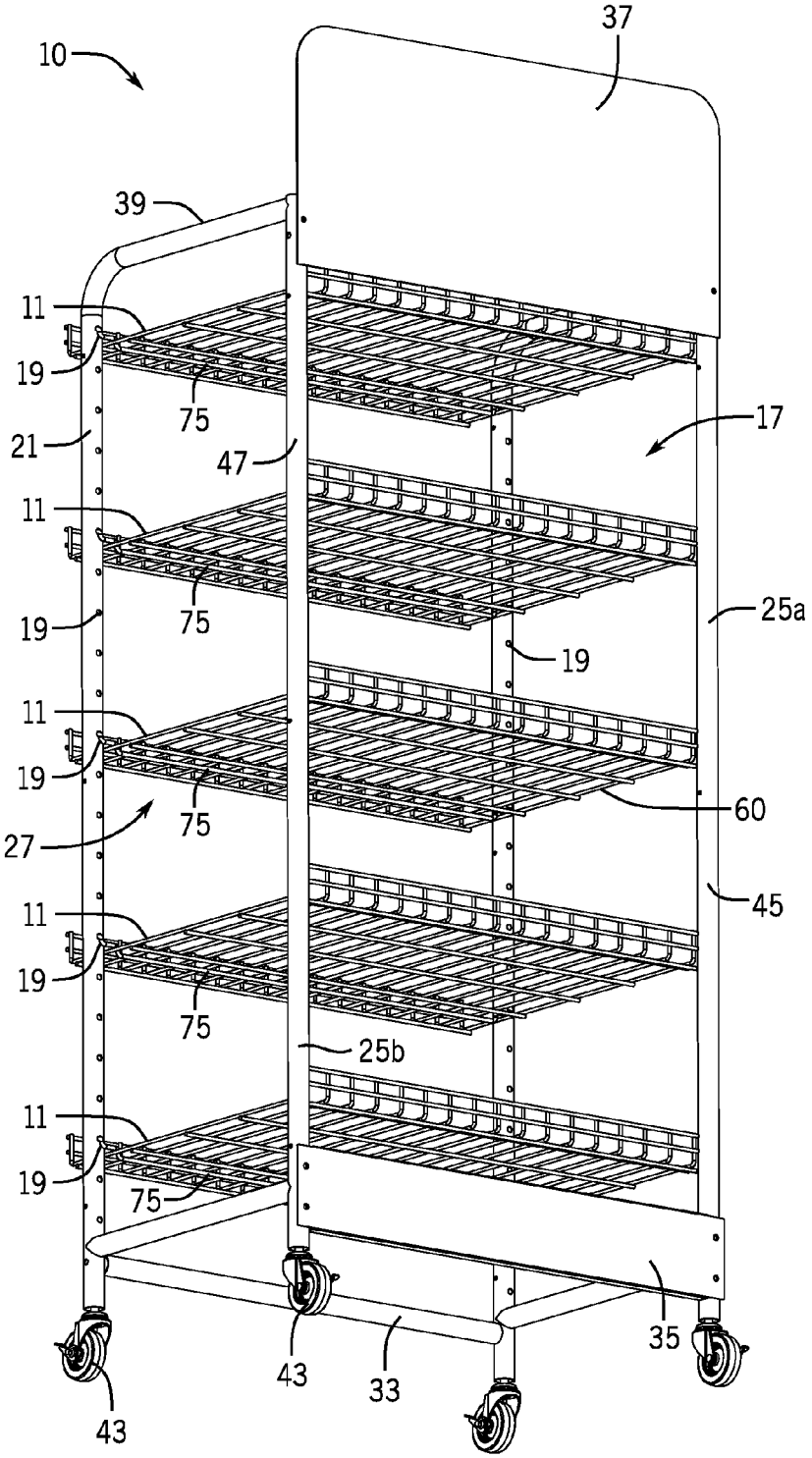
FIG. 2 is a further perspective view of the exemplary display rack of FIG. 1.

FIG. 1 shows that second pairs of apertures 21 are in a front orientation facing toward first side 15 of frame 13. FIG. 2 shows that first pairs of apertures 19 are in a rear orientation facing toward second side 17 of frame 13. FIGS. 1 and 2 illustrate that the exemplary apertures 19, 21 of each first and second pair of apertures 19, 21 may have a circumferential shape which is substantially round.

FIGS. 1-7 show frame 13 having first upright elements 23*a*, 23*b* and second upright elements 25*a*, 25*b*. First upright elements 23*a*, 23*b* may be considered a front upright element pair while second upright elements 25*a*, 25*b* may be considered a rear upright element pair in certain embodiments. Upright elements 23*a*, 25*a* and 23*b*, 25*b* may be considered lateral element pairs. In the examples, first upright elements 23*a*, 23*b* are parallel to second upright elements 25*a*, 25*b* and first and second upright elements 23*a*, 25*a* are parallel to first and second upright elements 23*b*, 25*b*. First, or front, set of vertically-spaced pairs of horizontally-aligned apertures 19 are along first upright elements 23*a*, 23*b*. Second, or rear, set of vertically-spaced pairs of horizontally-aligned apertures 21 are along second upright elements 25*a*, 25*b*. An advantage of the vertically-spaced pairs of horizontally-aligned apertures 19, 21 in the examples is that it is possible to adjust the shelf height by placing a shelf 11 at any available vertical position along upright elements 23*a*, 23*b*, 25*a*, 25*b* to thereby optimally display items on rack 10, 10A.

Collectively, first upright elements 23*a*, 23*b* and second upright elements 25*a*, 25*b* form a shelf space 27 therebetween. And, upright element pair 23*a*, 25*a* and upright element pair 23*b*, 25*b* define a shelf space lateral dimension 29 therebetween.

In the rack 10 embodiment of FIGS. 1-2, upper and a lower lateral cross members 31, 33, brace 35 and information-display panel 37 may span laterally between respective first and second upright elements 23*a*, 23*b* and 25*a*, 25*b* to provide rigidity to rack 10, 10*a* when assembled. Upper and lower cross members 39, 41 may be provided front-to-rear between first and second upright elements 23*a*, 25*a* and 23*b*, 25*b* to add further rigidity to rack 10, 10A. Preferably, upper and a lower cross members 31, 33, brace 35 and information-display panel 37 are removably secured to a respective front and rear upright element 23*a*, 23*b* and 25*a*, 25*b* by fasteners such as screws, bolts, etc. to permit rack 10, 10A to be shipped broken down and in a compact form and to be subsequently assembled. Such construction would also permit rack 10, 10A to be subsequently disassembled for storage. Advertisements and other information relevant to items on rack 10, 10A may be displayed on information-display panel 37.

A caster wheel 43 may optionally be attached to a lower end of each upright element 23*a*, 23*b*, 25*a*, 25*b*. Each caster wheel 43 enables rack 10, 10A to be easily pushed by a user across a floor or other surface.

Upright elements 23*a*, 23*b*, 25*a*, 25*b* are shown as hollow tubes which may be made of metal, plastic or any other suitable material with sufficient rigidity. Referring specifically to FIGS. 1-2, it can be seen that each aperture 19, 21 of each first or second aperture pair 19, 21 is stacked above and/or below each other aperture along each respective upright element 23*a*, 23*b* or 25*a*, 25*b* in a vertical line. The horizontal alignment of each first and second aperture pair 19, 21 and the vertical alignment of each aperture 19, 21 up and down each respective upright element 23*a*, 23*b*, 25*a*, 25*b*, allows shelves 11, 11*a* to be mounted on rack 10, 10*a* in a coordinated manner as described herein. For example, shelves 11, 11*a* could be coordinated by adjusting each self 11, 11*a* up and down frame 13 to the same angular position as in FIGS. 1 and 2 or FIGS. 3-4.

Figure 19:
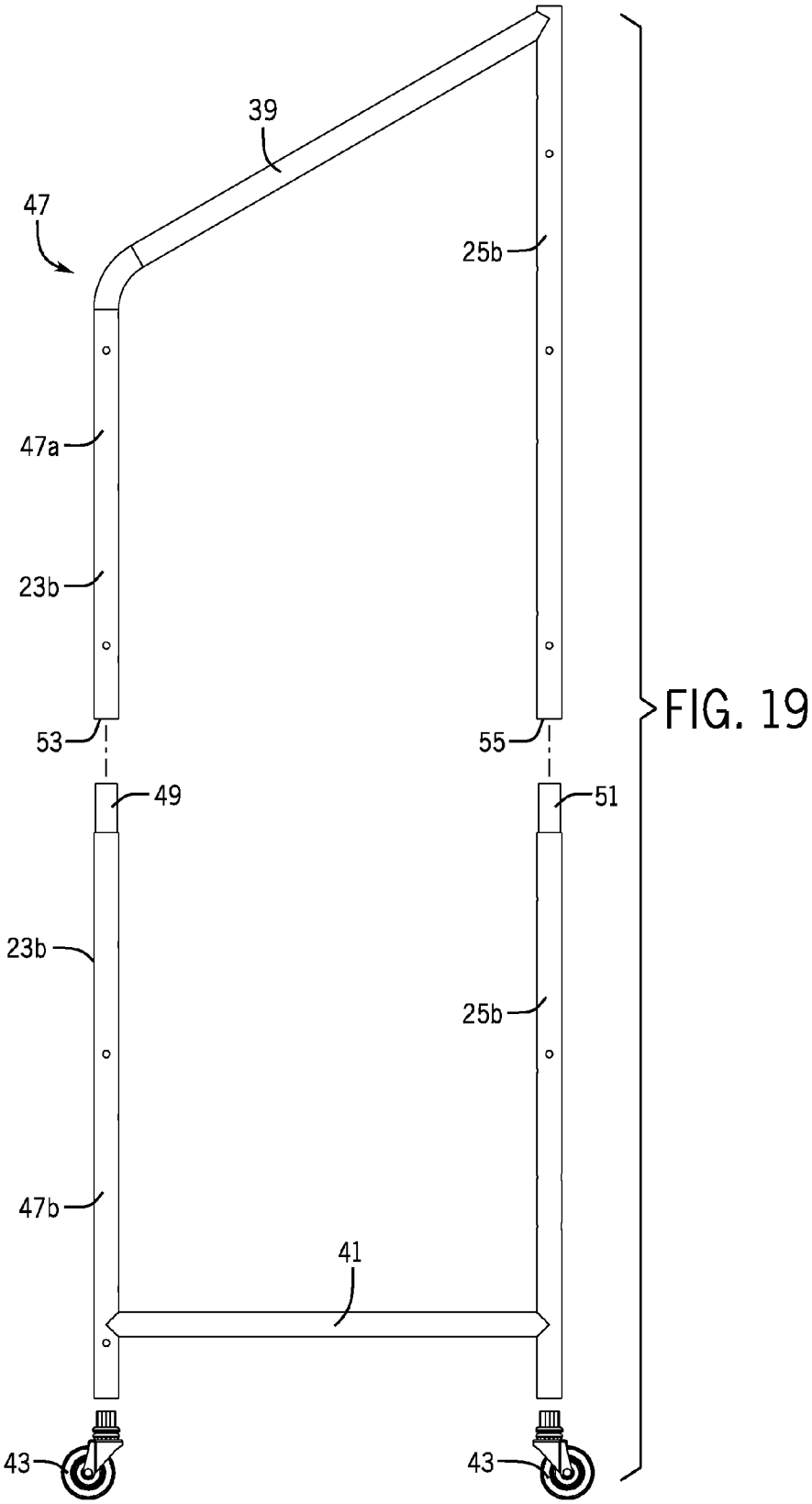
FIG. 19 is a side elevation view of a upright elements of FIGS. 3-4 illustrating that the upright elements can configured for assembly and disassembly.

Referring again to FIGS. 1-4 and 19, upright elements 23*a*, 25*a* and 23*b*, 25*b* could be provided in the form of a first side assembly 45 and a second side assembly 47. FIG. 19 illustrates that side assemblies 45, 47 can be constructed to permit assembly and disassembly, for example to permit display rack 10, 10A to be disassembled and collapsed for shipment or storage. FIG. 19 illustrates an embodiment of second side assembly 47, it being understood that side assembly 45 may be a mirror image of side assembly 47. In FIG. 19, side assembly 47 (and side assembly 45) can consist of an upper assembly 47*a*, and a lower assembly 47*b*. Narrowed portions 49, 51 of lower assembly 47*b* may be nested inside a respective hollow end 53, 55 of upper assembly 47*a*. Narrowed portions 49, 51 are shown as being formed by a tube end-portion having an outer dimension which is less than an inner dimension of hollow ends 53, 55. Upper assembly 47*a* can be separated from lower assembly 47*b* simply by removing narrowed portions 49, 51 from hollow ends 53, 55. First and second side assemblies 45, 47 of the type illustrated in FIG. 19 can be implemented with either or both of display racks 10, 10A.

Referring now to FIGS. 1-7, one or more shelf 11, 11*a* is located at least partially within shelf space 27 and within shelf space lateral dimension 29. For example, FIGS. 1-7, 15 and 16A-16F show shelf 11, 11*a* mostly within shelf space 27 but extending outward of frame 13 and beyond frame first side 15. In the example of FIGS. 1-2 and 5-7, five shelves 11 are provided and in the example of FIGS. 3-4, six shelves 11*a* are provided. Each shelf 11 or 11*a* embodiment is identified by the same respective reference number because the structure and operation of each shelf 11 or 11*a* is identical to the other. Any number of shelves 11, 11*a* may be provided consistent with the user's needs to display items. For example, a single shelf 11, 11*a* could be provided. Shelves 11, 11*a* are shown as wireframe-type shelves which may of metal, plastic or any other suitable material with sufficient rigidity.

FIGS. 8-11 show shelf 11, 11*a* including a first, or front, end 56, an opposite second, or rear, end 57, a first end portion 58, a second end portion 59 and lateral sides 60, 61. First end portion and second end portion 58, 59 merely refer to regions of shelf 11, 11*a* toward a respective first or second end 56, 57. Once again, the terms front and rear are non-limiting relative terms used merely for convenience because an advantage of rack 10, 10A shown in the examples is that shelves 11, 11*a* could be removed, rotated 180° and remounted in rack 10, 10A permitting a single rack 10, 10A to simultaneously display and permit access to items from both first and second sides 15, 17 of rack 10, 10A. In other embodiments, rack (e.g., rack 10, 10A) could be constructed so that shelves 11, 11*a* could be mounted toward a lateral side 18, 20.

In the examples, each shelf 11, 11*a* is of a wireframe type design and includes a plurality of spaced apart lateral cross members several of which are indicated by reference number 62 and a plurality of spaced apart first side 56 to second side 57 cross members several of which are indicated by reference number 63. Cross members 62, 63 collectively define a shelf plane 65 (FIGS. 8-9) in the examples. For embodiments utilizing steel wire as a cross member 62, 63 material, the wire can simply be welded where cross members 62, 63 intersect to provide a grid-type shelf 11, 11*a*.

In the examples, each shelf 11 or 11*a* has two outermost cross members 63*a*, 63*b* which respectively define the shelf lateral sides 60, 61 and provide lateral edges of shelf 11, 11*a*. Cross members 63*a*, 63*b* define a principal width 67 therebetween for the entire shelf 11, 11*a* located within shelf space 27 in the examples. In the embodiments illustrated in FIGS. 1-7, principal width 67 is less than lateral dimension 29 of frame 13.

Figure 3:
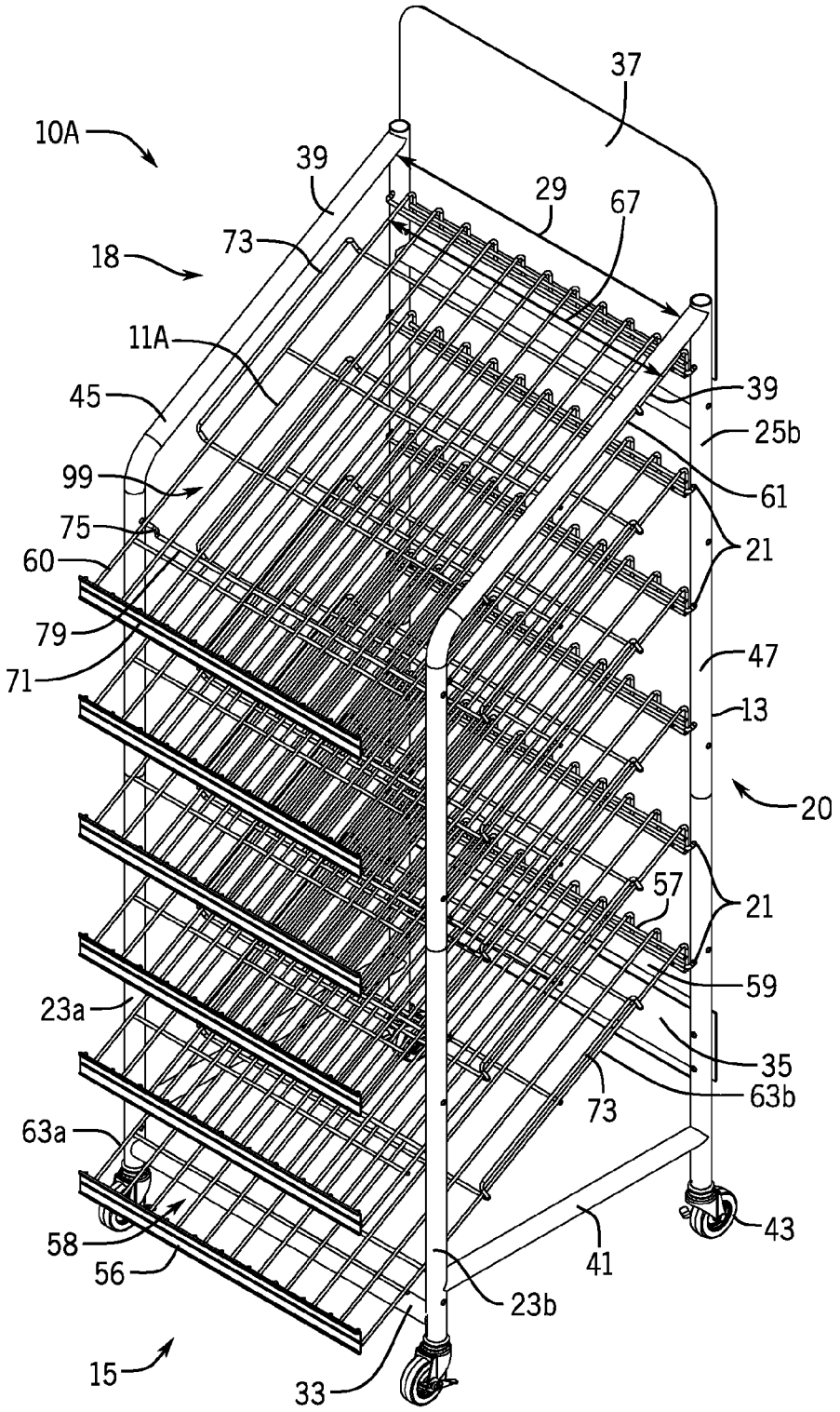
FIG. 3 is a perspective view of further embodiment of a display rack in accordance with the invention.
Figure 4:
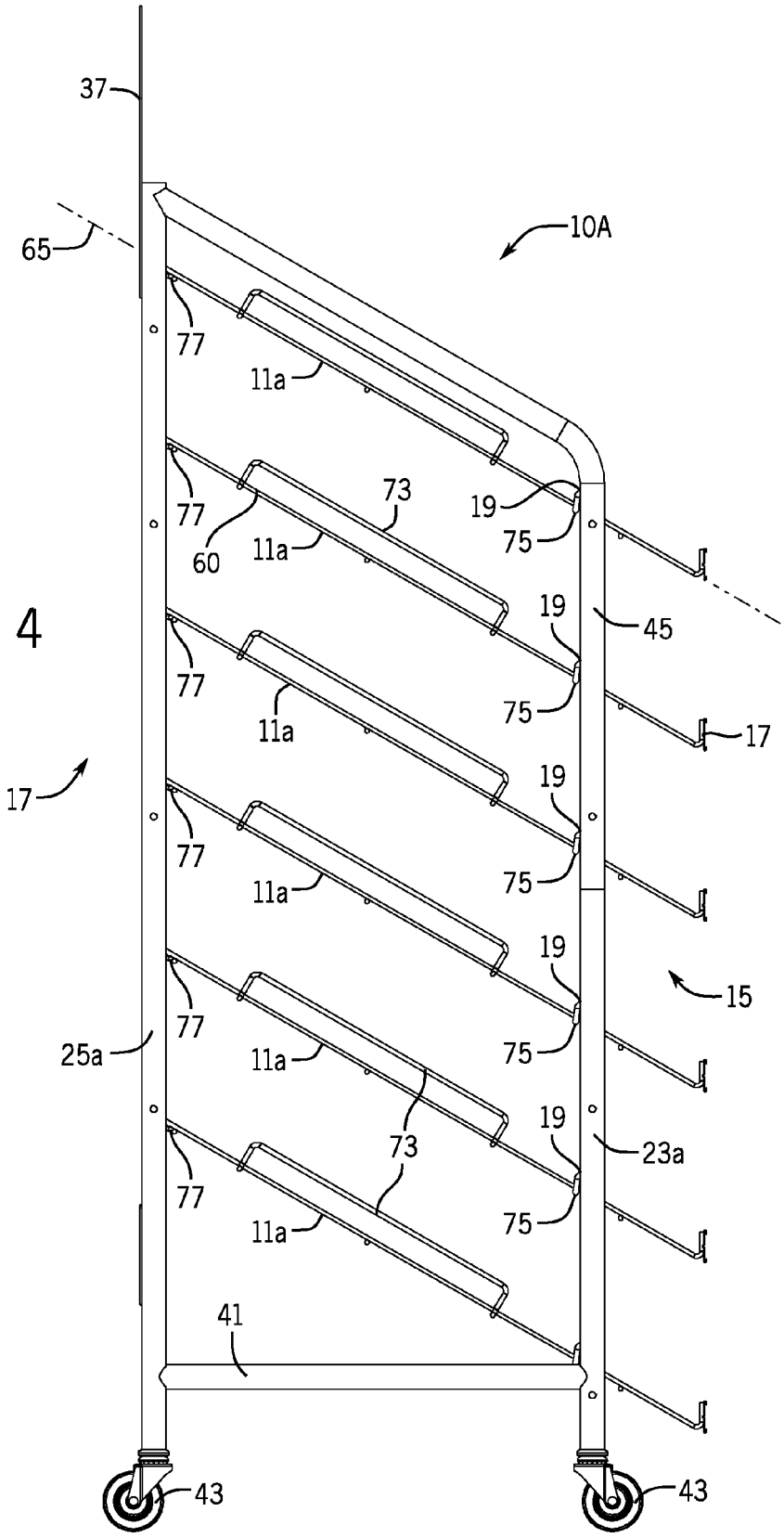
FIG. 4 is a side elevation view of the exemplary display rack of FIG. 3.
Figure 5:
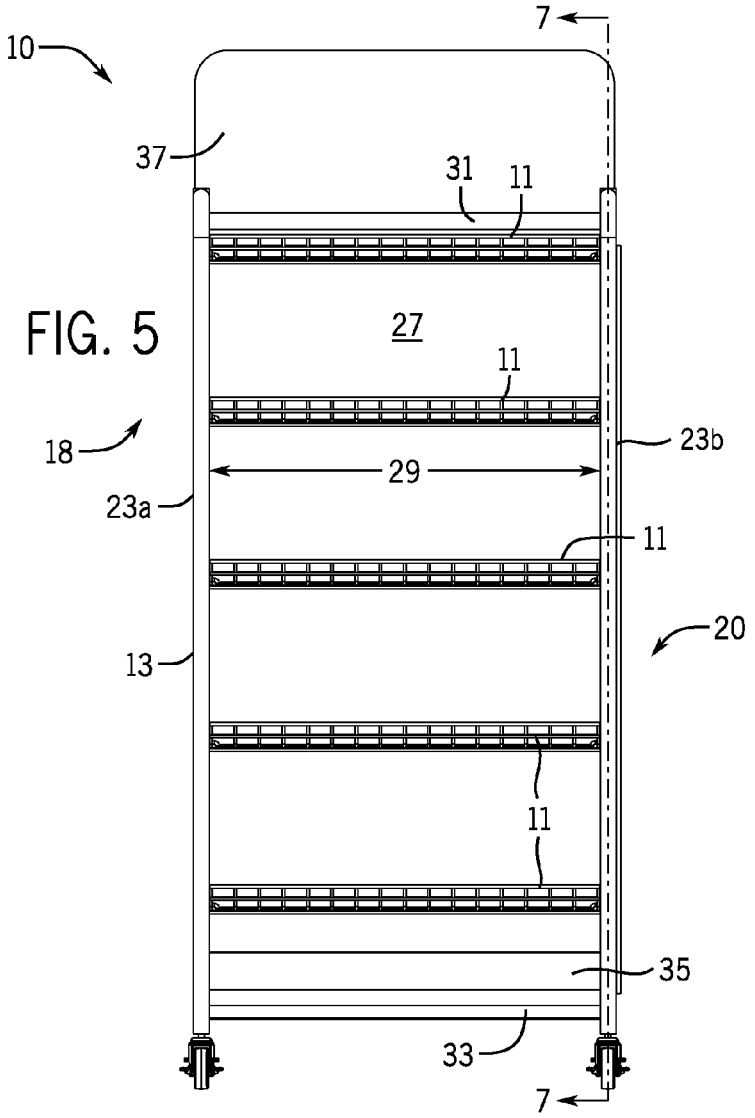
FIG. 5 is a first side elevation view of the exemplary display rack of FIG. 1.

Other shelf 11, 11*a* structure may optionally be implemented. For example, shelf 11, 11*a* may include a first side, or front, stop wall 71 of a wireframe-type construction. Stop wall 71 prevents items from falling off first end 56 of shelf 11, 11*a* particularly if first end 56 of shelf is lower than second end 57 of shelf 11, 11*a*. Stop wall 71 is particularly useful in "speed shelf" applications in which shelf plane 65 may be set at a relatively steep angle to the horizontal. Such a steep shelf plane 65 angle is illustrated in FIGS. 3-4. A steep shelf plane 65 angle is useful to allow items to slide down toward stop wall 71. As the lowermost item is selected and removed from shelf 11, 11A, the next item will slide down shelf 11, 11*a* and into contact with stop wall 71 for selection. A speed shelf arrangement is ideal for display of boxed or pre-packaged items which do not need to be displayed in a horizontal position and which can easily slide downward along shelf 11, 11*a*.

By way of further example, shelf 11*a* of FIGS. 3-4 is optionally provided with a pair of upright side walls 73 each extending laterally upward from shelf 11*a* substantially orthogonal with respect to shelf plane 65. Side walls 73 serve as lateral barriers preventing items on shelf 11*a* from falling off shelf 11*a* toward a lateral side 18, 20.

Proximate first end 56 of shelf 11, 11*a*, along shelf first end portion 58 is a movable support element 75 which both slides and rotates to adjustably engage the first pair of upright elements 23*a*, 23*b* as described herein. Proximate second end 57 of shelf 11, 11*a* along shelf second end portion 59 is a non-movable (i.e., fixed-position) support element 77 which engages the second pair of support elements 25*a*, 25*b*. Fixed-position support element 77 may be engaged with any of the first or second vertically-spaced pairs of horizontally-aligned apertures 19, 21 to permit the user to select the desired orientation of shelf 11, 11*a* (i.e., shelf first end portion 58 toward rack 13 first side 15 or second side 17) and shelf 11, 11*a* height on rack 10, 10A. Once fixed-position support element 77 is engaged with second pair of support elements 25*a*, 25*b*, then first end portion 58 of shelf 11, 11*a* can be raised or lowered pivoting about the engagement point of fixed-position support element 77 and the selected pair of upright elements 23*a*, 23*b* or 25*a*, 25*b* to adjust the desired angular position of shelf 11, 11*a*. Movable support element 75 is then engaged with the other pair of upright elements 23*a*, 23*b* or 25*a*, 25*b* to support shelf 11, 11*a* at least partially within shelf space 27 with shelf plane 65 at the desired angular position. In effect, first end portion 58 of shelf 11, 11*a* is selectively positioned among a plurality of angular positions relative to, or with respect to, second end portion 59 of shelf 11, 11A in the examples. Each position of first end portion 58 of shelf 11, 11*a* relative to, or with respect to, second end portion 59 of shelf 11, 11*a* locates shelf plane 65 in a different angular position.

Shelves 11, 11*a* may be removable from rack 10, 10A. However, in some embodiments it may be desirable for shelves 11, 11*a* to be pivotally attached to frame 13 at a predetermined height along shelf second end portion 59 permitting only angular adjustment of shelf first end portion 56 relative to shelf second end portion 57.

The structure and operation of exemplary movable and fixed-position support elements 75, 77 will now be described in detail.

Reference will now be made to FIGS. 8, 10-11 and 13-18 which illustrate embodiments of exemplary movable support element 75 provided to support shelf 11, 11*a* proximate shelf first end 56 and shelf first end portion 58. In the examples, movable support element 75 is a single-piece cross member 79 which spans laterally across shelf 11, 11*a* and is proximate shelf first end 56 along shelf end portion 58. A single-piece cross member 79 is highly advantageous because it can be easily manipulated with a single hand to lock shelf 11, 11*a* in place thereby freeing the user's other hand to raise or lower shelf 11, 11*a* to the desired angular position. Thus, movable support element 75 is advantageous from an ergonomic standpoint.

Steel wire is a preferred material for use in fabrication of single-piece cross member 79 of movable support element 75 because such wire material is sturdy and capable of supporting significant loads on shelf 11, 11*a*. In addition, such material can be easily bent or formed as necessary to both support shelf 11, 11*a* on rack 10 or 10A and engage first upright elements 23*a*, 23*b* or second upright elements 25*a*, 25*b* to hold shelf 11, 11*a* in the desired angular position. In certain embodiments such as those illustrated herein, movable support element 75 may be referred to as a "keeper wire" because movable support element 75 is a single piece of rigid wire which keeps shelf 11, 11*a* in the desired angular position.

Figures 13, 14, 14A:
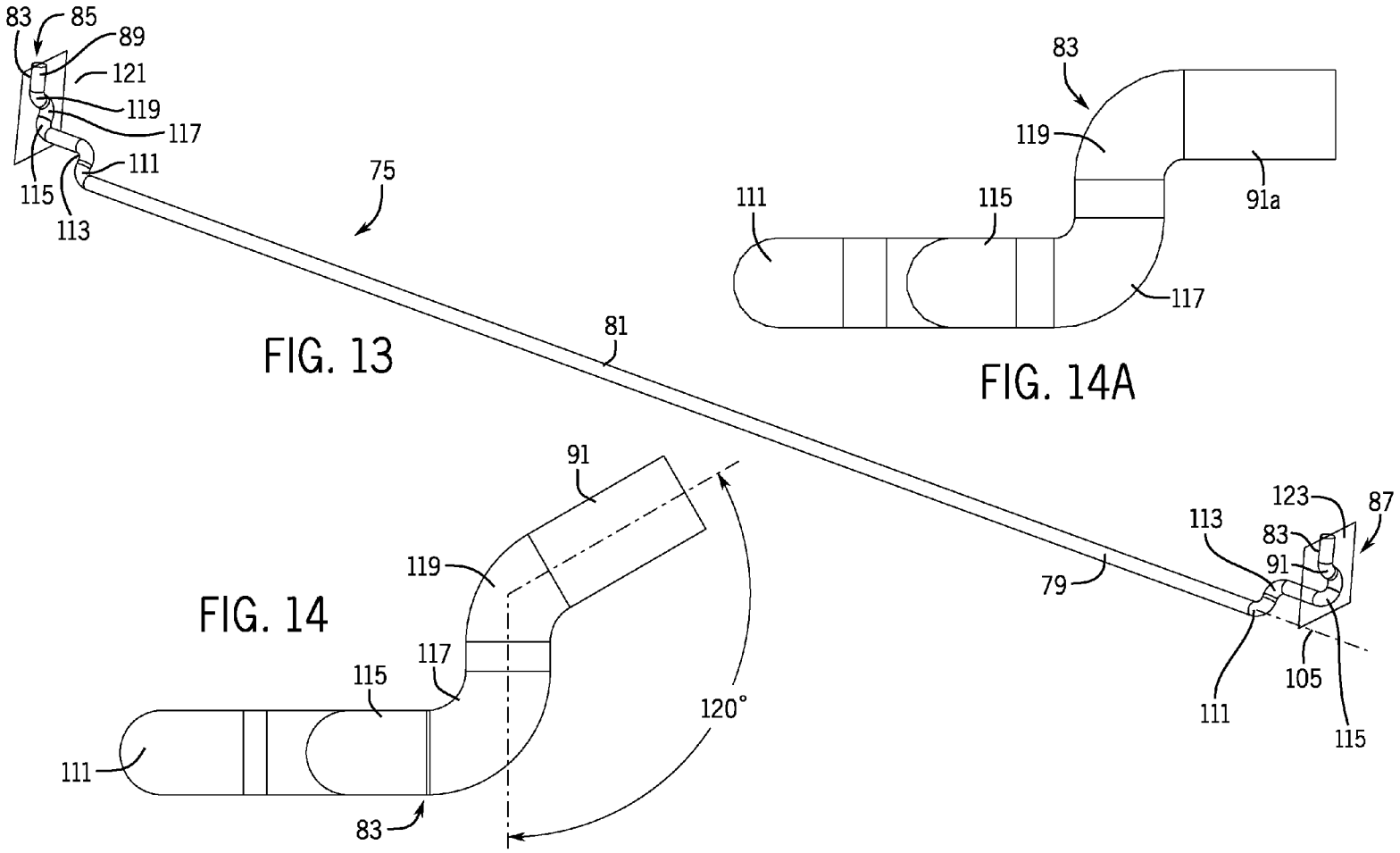
FIG. 13 is a perspective view of an exemplary movable support element.
FIG. 14 is a side elevation view of an engager of FIG. 13.
FIG. 14A is a side elevation of a further embodiment of an engager.

Referring now to FIGS. 13-14, there is illustrated an embodiment of a movable support element 75. Movable support element 75 in the examples includes an intermediate portion 81 and terminates in a pair of engagers 83 each at an opposite end 85, 87 of single-piece cross member 79. Engagers 83 are movable engagers because movable support element 75 is movable. Each engager 83 is the mirror image of the other in the examples. Each exemplary engager 83 is in the form of a generally hook-shaped catch 89, 91. Each catch 89, 91 of engager 83 may be inserted into a respective aperture 19 of first aperture pair 19 along first side 15 of frame 13.

Figure 10:
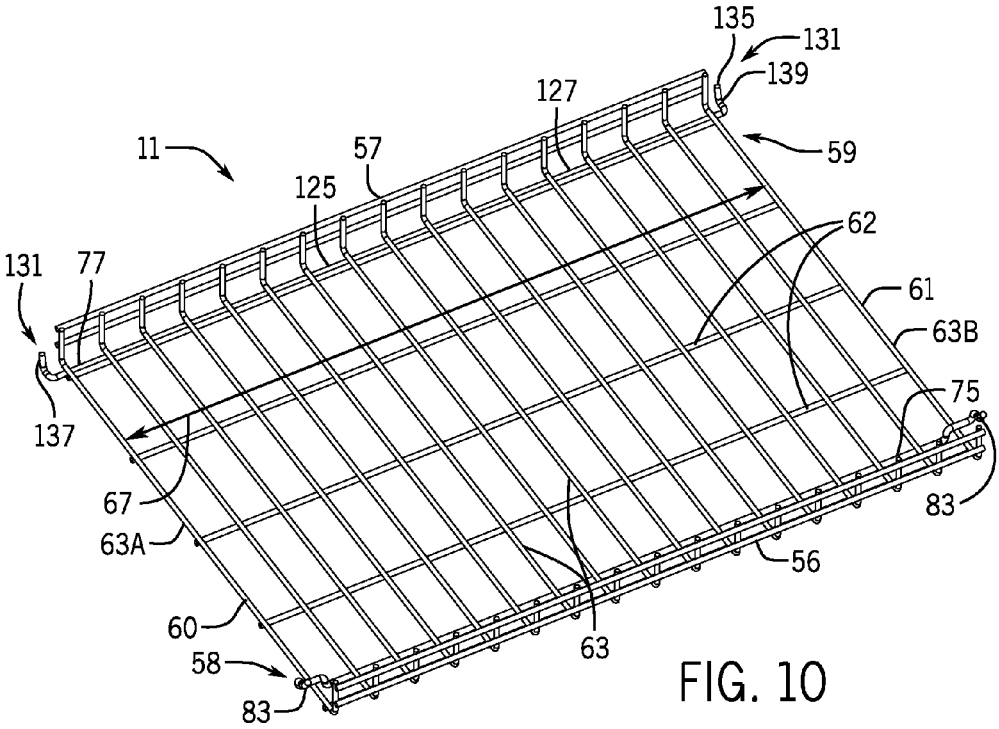
FIG. 10 is a top perspective view of an exemplary shelf for use with the display rack of FIG. 1.
Figure 11:
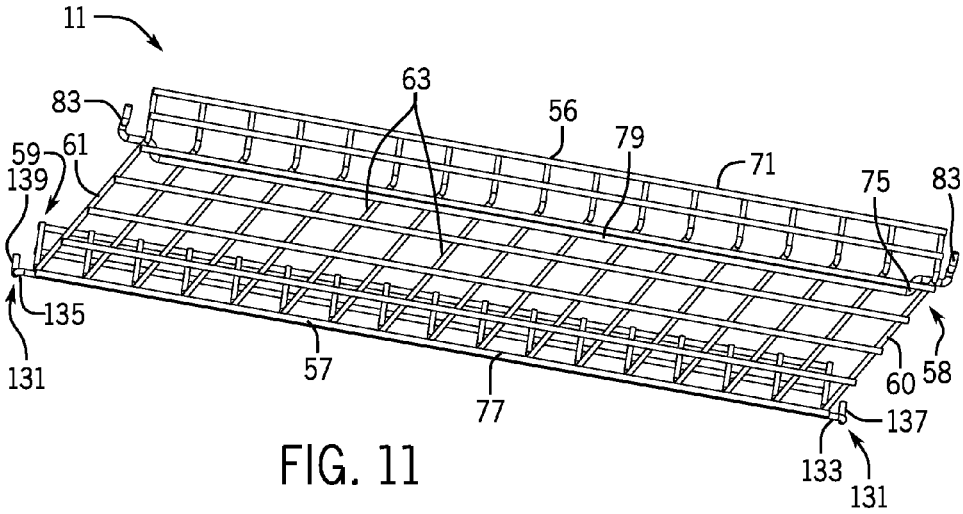
FIG. 11 is a bottom perspective view of the exemplary shelf of FIG. 10.

A benefit of rack embodiments 10, 10A is that shelf 11, 11*a* could be rotated 180° from the shelf positions illustrated in FIGS. 1-4 so that each catch 89, 91 of engager 83 could be inserted into a respective aperture 21 of second aperture pair 21 along second side 17 of frame 13, for example to display items along both first and second sides 15, 17 of frame 13. Each catch 89, 91 and engager 83 would be supported by frame 13 at a frame surface 92 or 94 defining aperture 19 or 21. Engagers 83 extend beyond principal width 67 of shelf 11, 11*a* as illustrated in the examples of FIGS. 10-11.

Figure 16A:
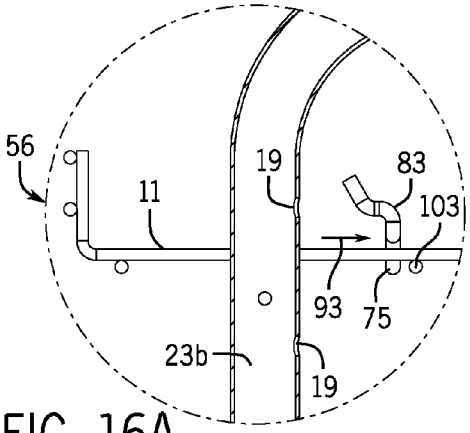
FIGS. 16A-16F are enlarged fragmentary cross-sectional views of detail portion 16-16 of FIG. 15 illustrating steps for engagement of the shelf first portion and movable support element with one of the upright elements.
Figure 16B:
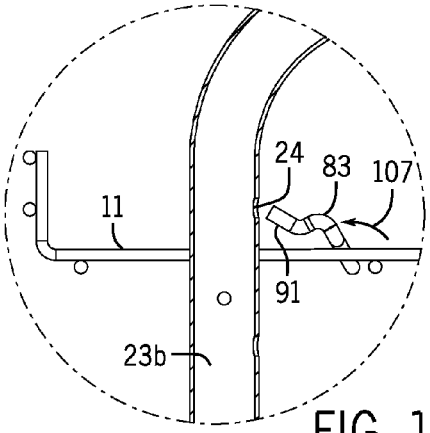
Figure 16C:
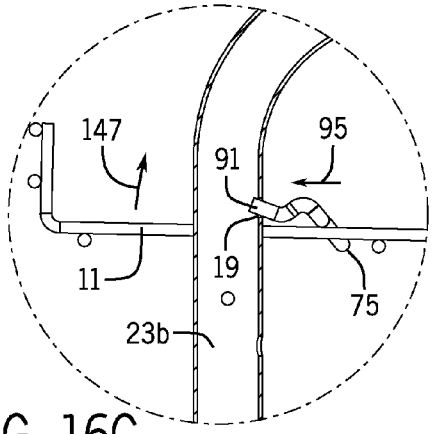
Figure 16D:
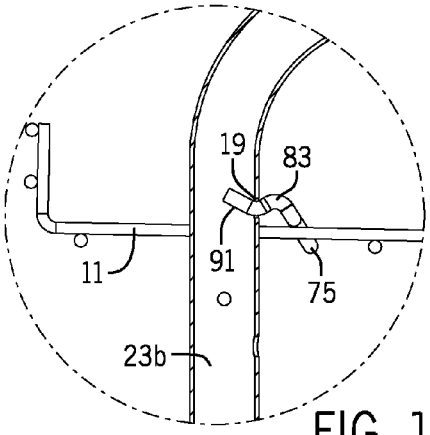
Figure 16E:
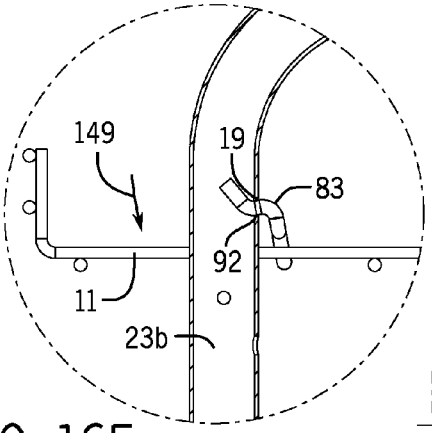
Figure 16F:
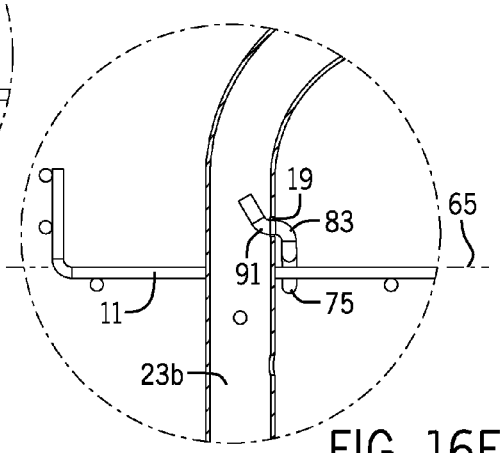
Figure 17:
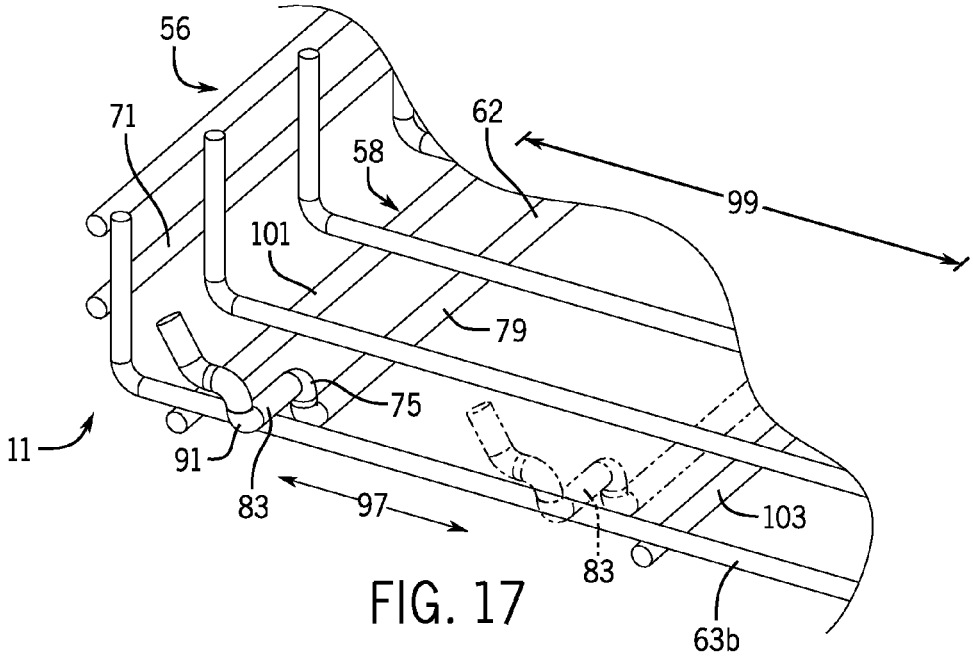
FIG. 17 is a fragmentary perspective view illustrating sliding movement of an exemplary movable support element and engager.

FIGS. 16-17 show that movable support element 75 and each engager 83 is slidable toward and, alternatively, away from shelf first end 56 or shelf second end 57 in front, and alternatively, rear directions (i.e., front-rear directions) in the examples as indicated by arrows 93, 95, and dual-headed arrow 97. FIGS. 6 and 15-17 show movable support element 75 and each engager 83 being slidable toward and, alternatively, away from first end 56 or second end 57 of shelf 11, 11*a* (i.e., in front-rear directions in the examples) within an adjustment region 99.

Figure 6:
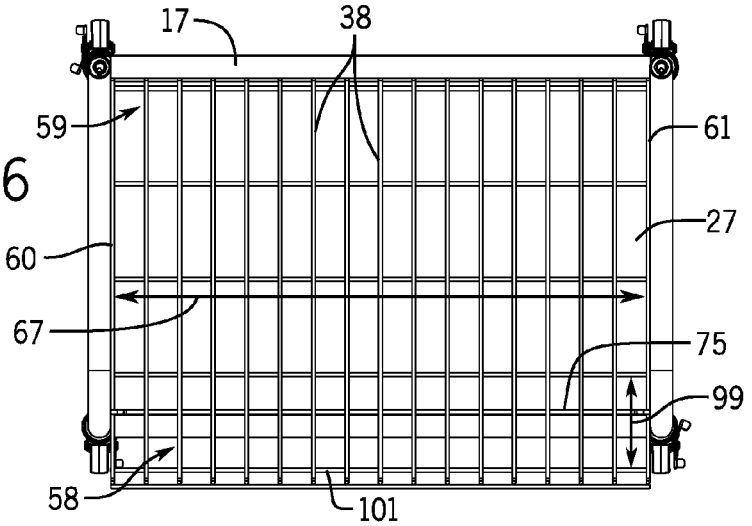
FIG. 6 is a top plan view of the exemplary display rack of FIG. 1.
Figure 15:
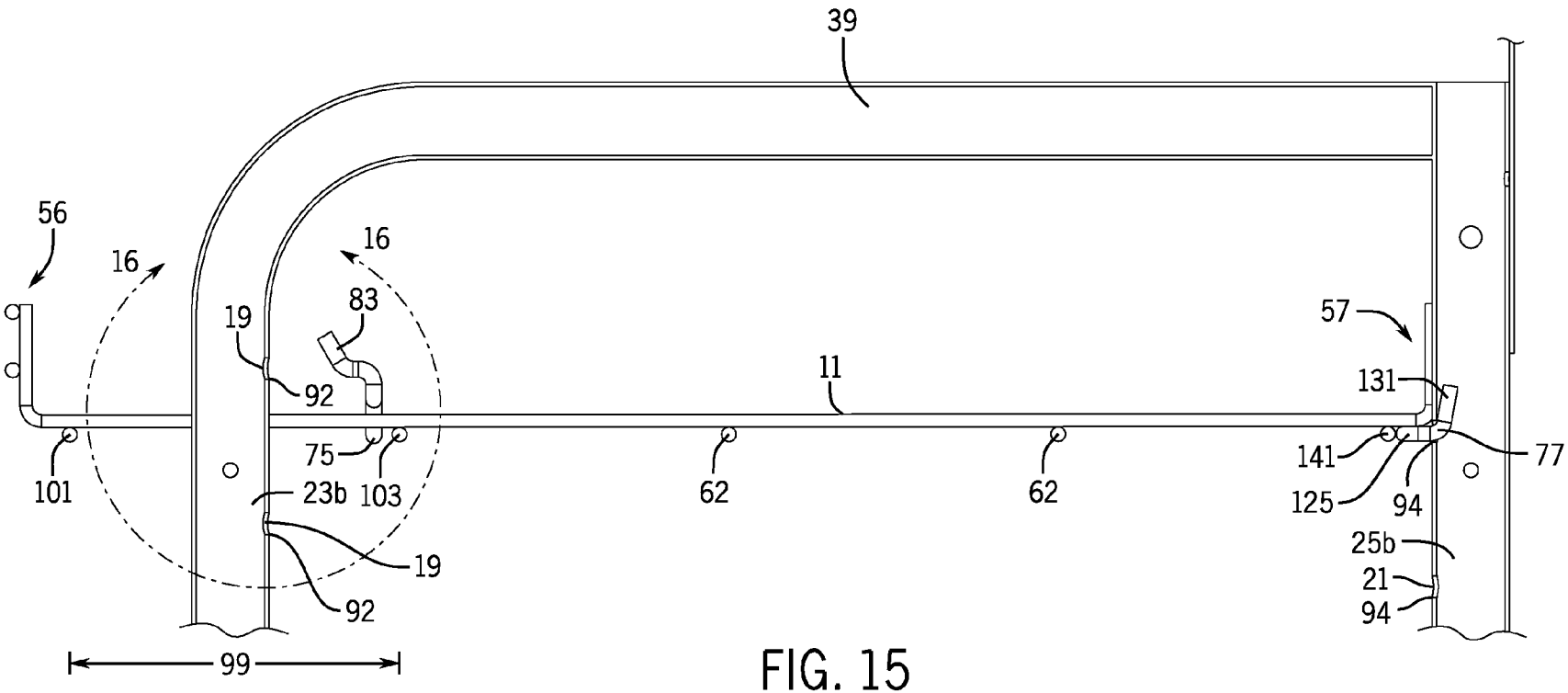
FIG. 15 is a fragmentary cross-sectional view taken along a section such as section 7-7 of FIG. 5 illustrating a shelf and upright elements with the shelf first portion and movable support element disengaged from the upright element.

In the examples, adjustment region 99 is bounded by first, or frontmost, lateral cross member 101 proximate shelf first end 56 and a second, or rearmost, lateral cross member 103 spaced apart from first lateral cross member 101 and between first lateral cross member 101 and shelf second end 57. Lateral cross member 101 can be in other positions of shelf 11,

11*a* closer to or further from shelf first end 56 and remain proximate said end 56. FIGS. 6 and 15 show that exemplary adjustment region 99 is about a quarter of the dimension between first and second ends 56, 57 of shelf 11, 11*a*.

The sliding capability of movable support element 75 is important to allow shelf 11, 11*a* to be set at the desired angular position on frame 13. As can be readily appreciated, the distance between apertures 19, 21 in a plane which is angled relative to horizontal is greater than the distance between apertures 19, 21 in a plane which is horizontal. Therefore, as the shelf first portion 58 is raised or lowered on frame 13 relative to shelf second portion 59 the sliding capability permits engagers 83 of movable support element 75 to slide along shelf 11, 11*a* as needed to engage catches 89, 91 of engagers 83 with the apertures 19 or 21 required to adjust shelf 11, 11*a* to the desired angular position.

Figure 18:
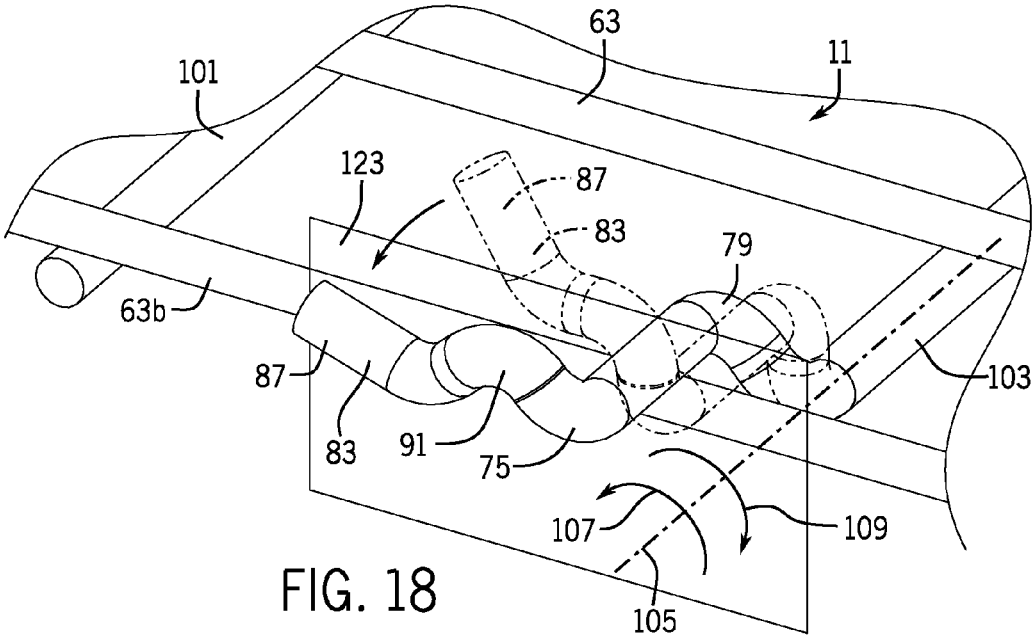
FIG. 18 is a fragmentary perspective view illustrating rotating movement of the exemplary movable support element and engager of FIG. 17.

FIGS. 16A-16F and 18 show that each engager 83 and catch 89, 91 of movable support element 75 is also rotatable clockwise and alternatively, counterclockwise about axis 105 which extends through intermediate portion 81 of single piece cross member 79 and laterally between lateral sides 60, 61 of shelf 11, 11*a*. The counter clockwise and clockwise directions of rotation of the illustrated movable support element 75 and engager 83 are shown respectively by arrows 107, 109 (FIGS. 16B and 18).

Movable support element 75 includes bends described in detail below. In the examples, the bends allow movable support element 75 to fit beneath and in contact with cross members 62 to thereby support shelf 11, 11*a* and items thereon with respect to frame 13. The bends also position engagers 83 so that they can slide and rotate to engage first upright elements 23*a*, 23*b* to lock shelf 11, 11*a* with shelf plane 65 in the desired angular position. The bends also keep movable support element 75 in contact with shelf 11, 11*a*.

FIGS. 8, 13-14 and 17-18 well illustrate exemplary bends in movable support element 75. The bends are outboard of intermediate portion 81 at ends 85, 87 of single-piece cross member 79 forming movable support element 75 in the examples. Such bends resulting in the two engagers 83 are mirror images of each other.

Referring then to the examples of FIGS. 8, 13-14 and 17-18 bends of engager 81 at ends 85, 87 of movable support element 75 may be as follows. A first 90° bend 111 bends single-piece cross member 79 transverse to axis 105 and a second 90° bend 113 bends single-piece cross member 79 parallel to, and spaced from, axis 105. Single-piece cross member 79 extends outwardly to a third 90° bend 115 which is transverse to axis 105. A further pair of bends 117, 119 transverse to axis 105 bend single-piece cross member 79 generally up and define a catch 89, 91 of each engager 83 at a respective terminal end 85, 87 of single-piece cross member 79. As illustrated in FIG. 14, bends 117, 119 preferably comprise an angle of approximately 120°. FIG. 14A illustrates an alternative embodiment of a catch 91*a* which could be used in place of catch 89 and 91. According to FIG. 14A, bends 117, 119 preferably comprise approximately 90° angles indicating that variation is contemplated with respect to the structure of catch 89, 91.

When single-piece cross member 79 is rotated in either the clockwise or counterclockwise directions indicated by arrows 107, 109, each catch 89, 91 rotates about axis 105 in a respective plane 121, 123 which is orthogonal to axis 105 and substantially parallel to lateral sides 18, 20 of frame 13 of rack 10, 10A. These separate planes 121, 123 of catch 89, 91 rotation are substantially parallel planes substantially orthogonal to shelf plane 65.

Referring now to FIGS. 17-18, rotation of single-piece cross member 79 and of catch 89, 91 is limited in the examples by contact between outer cross members 63*a*, 63*b* and single-piece cross member 79 between second and third bends 113, 115.

FIG. 18 shows such region of rotation of catch 89, 91 being limited to about 70° from vertical which is helpful to align catch 89, 91 with aperture 19 or 21 of each aperture pair 19, 21 for engagement with first upright elements 23*a*, 23*b* or second upright elements 25*a*, 25*b*.

Figures 12, 12A, 12B:
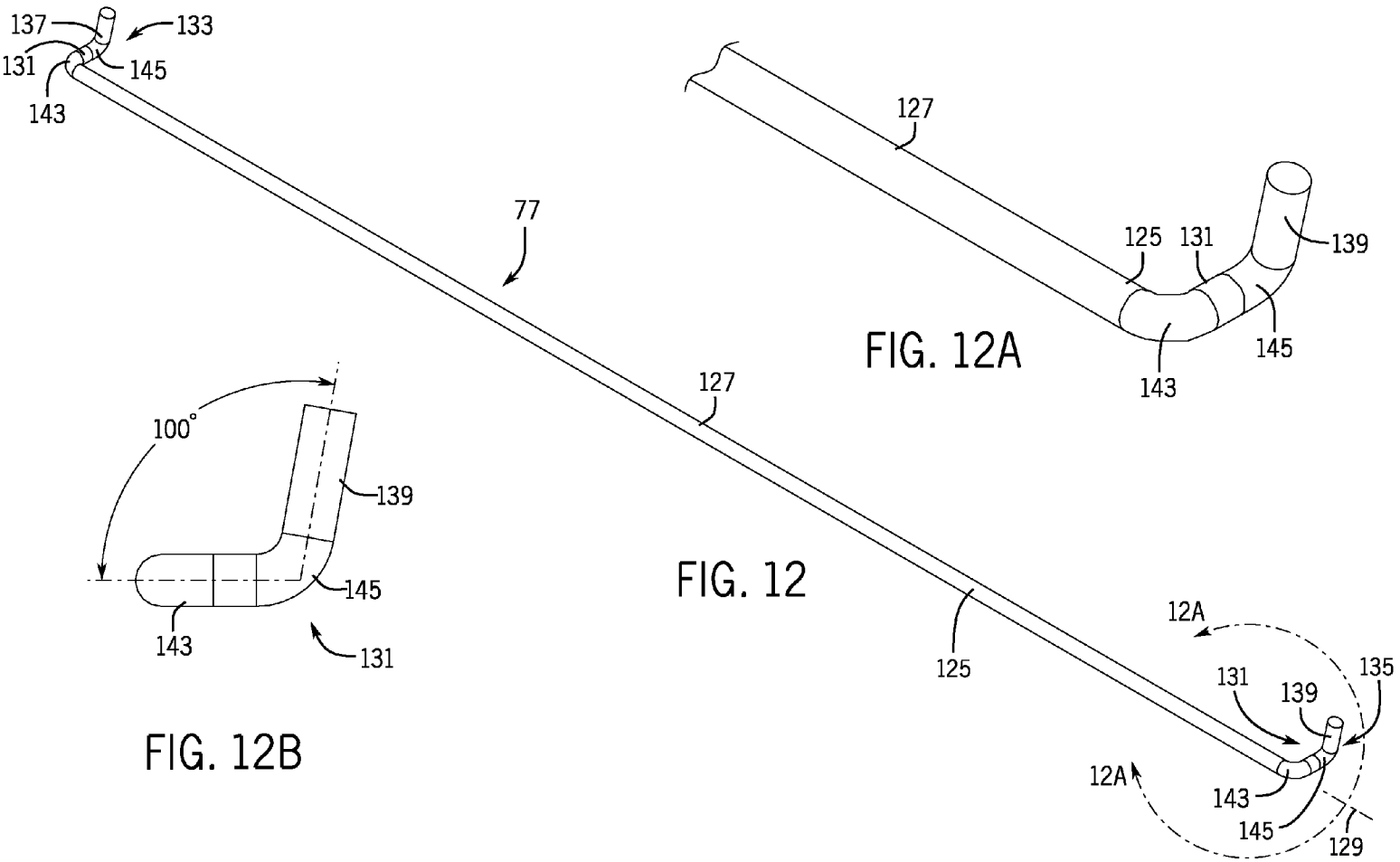
FIG. 12 is a perspective view of an exemplary nonmovable support element.
FIG. 12A is an enlarged fragmentary perspective view taken along detail portion 12A-12A of FIG. 12 illustrating an engager.
FIG. 12B is a side elevation view of the engager of FIG. 12A.

Reference will now be made to FIGS. 9-12B which illustrate embodiments of exemplary nonmovable support element 77 provided to support shelf 11, 11*a* proximate shelf second end 57 and second end portion 59. Nonmovable support element 77 may comprise a single-piece cross member 125 which may be of steel wire. Nonmovable support element 77 in the examples includes an intermediate portion 127 along axis 129 and terminates in a pair of nonmovable engagers 131 each at an opposite end 133, 135 of single-piece cross member 125. Each engager 131 is the mirror image of the other in the examples. Each nonmovable engager 131 is in the form of a generally hook-shaped catch 137, 139 which may be shaped as illustrated in FIGS. 12-12A. Each catch 137, 139 of engager 131 is inserted into a respective aperture 21 of second aperture pair 19 along second side 17 of frame 13 of rack 10, 10A. Alternatively, catches 137, 139 may be inserted into a respective aperture 19 of first aperture pair 19 along second side 17 of frame 13 of rack 10, 10A in which case catches 89, 91 would be inserted into an aperture 21 of second aperture pair 19. Engagers 131 extend beyond principal width 67 of shelf 11, 11*a* as illustrated in the examples of FIGS. 10-11.

Figure 9:
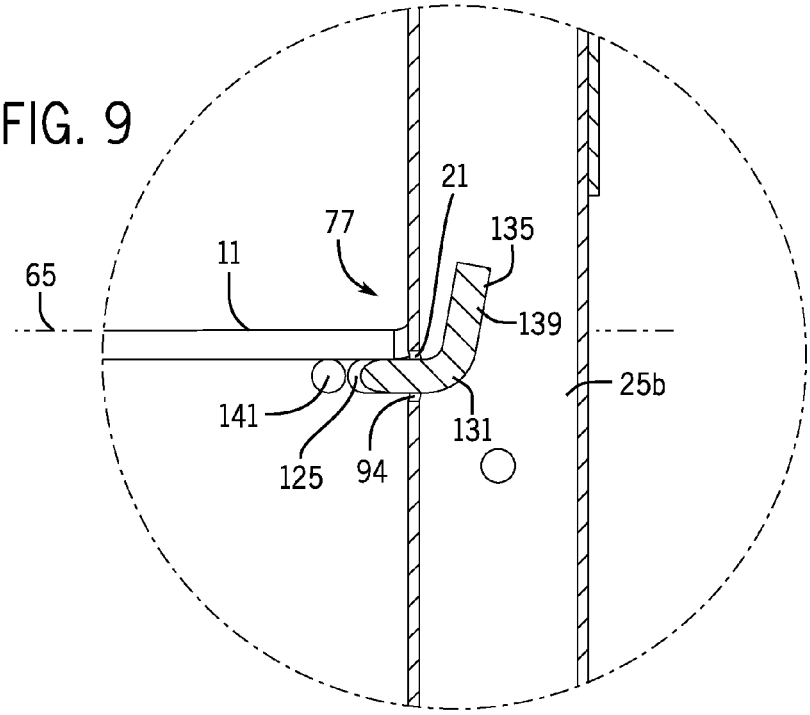
FIG. 9 is an enlarged fragmentary cross-sectional view taken along detail portion 9-9 of FIG. 7 illustrating a nonmovable engager engaged with an upright element aperture.

Referring further to the examples of FIGS. 9-11, single-piece cross member 125 is attached to shelf 11 (and shelf 11*a*) in a fixed, nonmovable manner. For example, single-piece cross member 125 could be welded against lateral cross member 141. Single-piece cross member 125 is preferably beneath shelf plane 65.

Nonmovable support element 77 includes bends described in detail below. The bends permit shelf 11, 11*a* to engage a pair of the second apertures 21 (or first apertures 19) to thereby support shelf 11, 11*a* and items thereon with respect to frame 13. Bends also permit shelf 11, 11*a* to pivot about the contact point with upright elements 25*a*, 25*b* or 23*a*, 23*b* to raise or lower shelf 11, 11*a* shelf first end 56 and first end portion 58 to position shelf 11, 11*a* with shelf plane 65 in the desired angular position.

FIGS. 9 and 12-12A well illustrate exemplary bends in nonmovable support element 77. The bends are outboard of intermediate portion 127 at ends 133, 135 of single-piece cross member 125 forming nonmovable support element 77 in the examples. Such bends resulting in the two engagers 131 are mirror images of each other.

Referring then to the examples of FIGS. 9, 12-12A bends of engager 131 at ends 133, 135 of nonmovable support element 77 may be as follows. A first 90° bend 143 bends single-piece cross member 125 transverse to axis 129 and a second bend 145 of approximately 100° bends single-piece cross member 125 up to define catch 137 or 139 of each engager 131 at respective terminal end 133, 135 of single-piece cross member 125. FIG. 12B illustrates an alternative embodiment of a catch 137*a* which could be used in place of catch 137, 139 and which includes an upward bend of approximately 90° indicating that variation is contemplated with respect to the structure of catch 137, 139.

Figure 7:
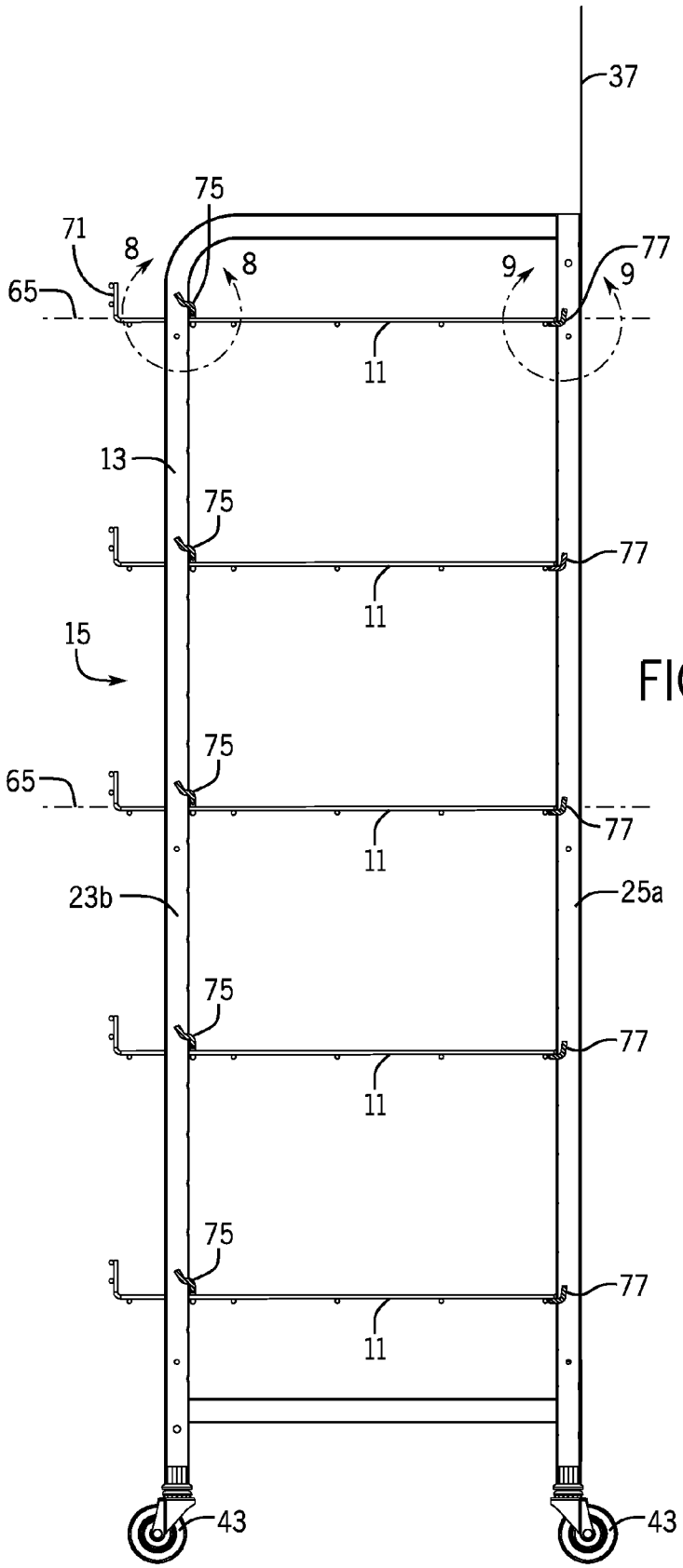
FIG. 7 is a cross-sectional view taken along section 7-7 of FIG. 5.

Each of nonmovable engagers 131 provides a pivot range at the contact pint with upright elements 25*a*, 25*b* or 23*a*, 23*b* for the angular adjustment of shelf plane 65 as can be appreciated by comparison of FIGS. 3-4 and 7 and 9. FIG. 9 shows the angular spacing between catch 137 and an inner surface of hollow upright element 25*b*. Such angular spacing allows pivoting of shelf 11 for angular adjustment of shelf 11. FIGS. 7 and 9 illustrate rack 10 with shelf 11 and shelf plane 65 in a horizontal position. FIGS. 3-4 illustrate display rack 10A of the second embodiment of the present invention with shelves 11*a* positioned at about 30° to horizontal. In some alternative embodiments, the angular adjustment of shelf plane 65 may be between 0° and 60° with respect to horizontal.

Figure 8:
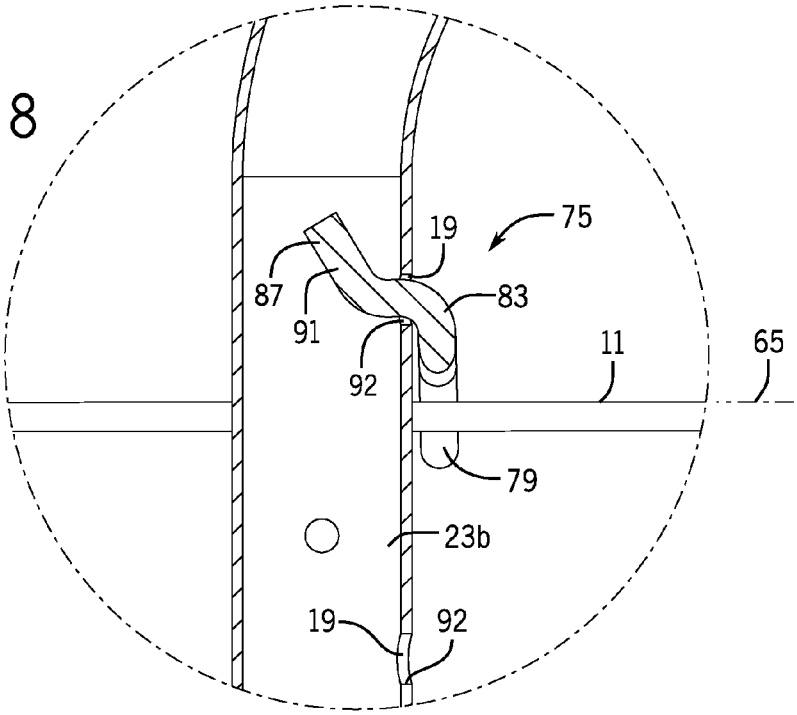
FIG. 8 is an enlarged fragmentary cross-sectional view taken along detail portion 8-8 of FIG. 7 illustrating a movable engager engaged with an upright element aperture.

FIGS. 7-9 show apertures 19, 21 of first and second pairs of apertures 19, 21 as openings which provide access to a respective engager 83, 131 into hollow upright element 23*a*, 25*a* in embodiments where upright element 23*a*, 25*a* (and upright elements 23*b*, 25*b*) is a tube. FIG. 15 shows shelf 11 in an intermediate position wherein shelf 11 nonmovable support element 77 is engaged with each second upright element 25*a* (and 25*b*), but prior to engagement of movable support element 75 not engaged with each first upright element 23*a* (and 23*b*).

Operation of rack 10 and adjustment of shelf 11 with shelf plane 65 at the desired angular position will now be described with respect to FIGS. 15-16F. Rack 10A and shelf 11*a* operate in the same manner and the description of FIGS. 15-16F is incorporated by reference with respect to rack 10A and shelf 11*a*.

FIGS. 15A-16F illustrate steps for mounting shelf 11 with shelf plane 65 in a horizontal position generally parallel to a floor surface (not shown) on which rack 10 is resting on wheels 43. The same steps are performed for mounting shelf 11 with shelf plane 65 at other angular orientations with respect to horizontal. The sliding capability of movable support element 75 makes it possible to mount shelf 11, 11*a* with shelf plane 65 at the other angular positions as previously described.

Referring then to FIG. 15, in a first step, nonmovable support 77 nonmovable engagers 131 and catches 137, 139 are inserted into and engaged with a respective aperture 21 of a second upright element 25*a*, 25*b* to rest on surface 94 of upright element 25*a*, 26*b*. This permits shelf 11 to pivot about the engagement point of nonmovable support 77 and upright element 25*a*, 25*b* as the shelf plane 65 is inclined or declined.

Referring next to FIGS. 15 and 16A, in a second step movable support element 75 with movable engagers 83 slides away from each first upright element 23*a*, 23*b* toward shelf second end 57 in the direction of arrow 93. The user may easily accomplish this second step simply by grasping and holding shelf 11 with one hand while grasping and sliding movable support element 75 in the direction of arrow 93 to an inward position along adjustment region 99. With movable support element 75 in this inward position disengaged from first upright elements 23*a*, 23*b* and a pair of first apertures 19, shelf 11 can be freely pivoted to a selected angle of shelf plane 65.

The angular position of shelf plane 65 is determined by engagement of movable support element 75 with a pair of first apertures 19. Because the pairs of first apertures 19 are stacked in a vertical line along first upright elements 23*a*, 23*b*, considerable variation is permitted with respect to the selected angle of shelf plane 65. Sliding movement of movable support element 75 within adjustment region 99 toward or away from shelf second end 57 permits engagement of engagers 83 with first upright elements 23*a*, 23*b* as the angle of shelf plane 65 changes and the distance between the first and second apertures 19, 21 increases or decreases based on such shelf plane 65 angle.

Referring next to FIG. 16B, in a third step the user rotates movable support element 75 with the user's fingers causing catches 89, 91 of engagers 83 to rotate in a respective plane 121, 123 in the direction of arrow 107 about axis 105. Rotation continues until there is contact between outer cross members 63*a*, 63*b* and single-piece cross member 79 between second and third bends 113, 115 for the alignment purpose described previously wherein each catch 89, 91 is facing toward a selected one of the pair of apertures 19.

In a fourth step and as illustrated in FIG. 16C, shelf 11 is lifted with one hand slightly upward in the direction of up arrow 147. The user's other hand slides movable support element 75 in the direction of arrow 95 toward first upright elements 23*a*, 23*b* and toward shelf first end 56 and away from shelf second end 57. The sliding step is also well illustrated in FIG. 17.

Referring again FIG. 16C and to FIG. 16D, each catch 89, 91 of engagers 83 is inserted into and engaged with the selected one of the apertures 19 of first upright elements 23*a*, 23*b*. During insertion of catch 89, 91 into an aperture 19, single-piece cross member 79 of movable support element 75 slides in the direction of arrow 95, toward shelf first end 56 and away from shelf second end 57, and rotates in the direction of arrow 109 as each catch 89, 91 is inserted more fully into aperture pairs 19 of first upright elements 23*a*, 23*b*.

Referring lastly to FIGS. 16E and 16F, those figures illustrate the final operational steps of shelf 11 adjustment. As illustrated in FIG. 16E, shelf 11 is lowered with the user's hand in the direction of the down arrow 149 as single-piece cross-member 79 of movable support element 75 slides in the direction of arrow 95 toward first upright elements 23*a*, 23*b* and shelf first end 56 and away from shelf second end 57 and rotates in the direction of arrow 109 to become fully inserted and engaged with aperture 19 of first aperture pair 19 as illustrated in FIG. 16F.

In the position illustrated in FIG. 16F, catch 89, 91 of each engager 83 between bends 117, 119 rests against an edge surface 92 of a respective first upright element 23*a*, 23*b* at the bottom of aperture 19 of first aperture pair 19. Downward force applied by shelf 11 holds shelf 11 in place by urging each catch 89, 91 against first upright element 23*a*, 23*b*. As more force is applied, each catch 89, 91 is cammed by contact with edge surface 92 of first upright element 23*a*, 23*b* beneath aperture 19 into a more fully engaged position with first upright element 23*a*, 23*b*. In effect, downward force applied by shelf 11 locks single-piece cross-member 79 of movable support element 75 in place against edge surface 92 securing shelf 11 with shelf plane 65 in the desired angular position.

Shelf 11 can be easily re-positioned at a different angle simply by reversing the steps of the process. Single-piece cross-member 79 of movable support element 75 has sufficient freedom to slide in the directions of arrows 93, 95, 97 within adjustment region 99 to permit shelf 11 to be set with shelf plane 65 at the appropriate desired angle.

Thus, as shown in the disclosed embodiments, the present invention provides an exceptionally simple and economical display rack 10, 10A with one or more shelves 11, 11*a* which can be securely placed in position and utilized in various different inclined orientations. Single-piece cross-member 79 of movable support element can be easily manipulated with a single hand of the user. This allows the user to raise or lower shelf 11 with one hand and to slide and rotate single-piece cross-member 79 of movable support element 75 with the user's other hand. This is much easier than prior display racks which require operation of complex mechanisms or deformation of parts in order to adjust an angular position of a shelf. The ability to easily change the angle of shelf plane 65 relative to horizontal with one hand is an important advantage, particularly from an ergonomic perspective.

The adjustability of each individual shelf 11, 11*a* made possible by the present improved rack 10, 10A allows a user to easily select the angle of each shelf 11, 11*a* best suited to the items to be displayed. Some items may require storage on a shelf 11, 11*a* with steeper shelf plane 65 angle relative to horizontal, for example in speed shelf applications, to facilitate movement of items toward the customer making access easier to the customer and providing automatic replenishment. Other items, such as fresh-baked breads, pies and cakes, may be best displayed on shelf 11, 11*a* with shelf plane 65 in a more horizontal orientation. The ability to easily adjust the angular position of 11, 11*a* permits the user to display items in an optimal manner.

Yet another advantage of the display rack is that shelves may be separately inclined toward the first side 15, second side 17 or a lateral side 18, 20 of rack 10, 10A. This would permit a single display rack 10, 10A to be located between aisles of a store or at an end of the aisle and to display merchandise to shoppers in each aisle or at the ends of the aisles.

The invention is not limited to the particular details of the apparatus depicted and other modifications and applications may be contemplated. By way of example only, movable and/or nonmovable support elements 75, 77 could be above shelf plane 65 to support shelf 11 with respect to rack 13. Movable support element 75 could, for example, be supported above shelf plane 65 by a sliding sleeve secured to shelf 11 and which would permit rotation of movable support element 75 with respect to sleeve for the same purposes described above. Nonmovable support element 77 could be attached, for example by welding, to shelf 11 above shelf plane 65. Certain other changes may be made in the above-described apparatus without departing from the true spirit and scope of the present invention.

While the principles of the invention have been shown and described in connection with specific embodiments, it is to be understood that such embodiments are by way of example and are not limiting.

The invention claimed is:

1. A display rack, comprising:

a frame having first and second pairs of upright elements, the upright elements defining a shelf space and a lateral dimension therebetween and including a plurality of vertically-spaced apertures, the apertures of such upright elements including pairs of apertures at corresponding vertical positions therealong; and at least one shelf of a principal width at least partially within the shelf space, the shelf including (a) first and second ends, (b) a first end portion with a pair of movable engagers for engagement with a pair of apertures of one of the first and second pairs of the upright elements, and (c) a second end portion with a pair of nonmovable engagers for engagement with a pair of the apertures of the other of the first and second pairs of the upright elements, the pair of movable engagers being the ends of a single-piece cross-member defining a single axis, the single-piece cross-member being rotatable about the single axis and slidable toward and, alternatively, away from the second end, thereby allowing angular adjustment of a shelf plane by selective positioning of the first end portion with respect to the second end portion wherein the vertically-spaced apertures for supporting the pair of movable engagers face the vertically-spaced apertures for supporting the pair of nonmovable engagers.

2. The rack of claim 1 wherein the frame has first and second sides and the pair of apertures engaged with the movable engagers face the second side of the frame and the pair of apertures engaged with the nonmovable engagers face the first side of the frame.

3. The rack of claim 1 wherein each aperture is substantially round.

4. The rack of claim 1 wherein the shelf has two lateral edge members defining the principal width for the entire shelf, the principal width being less than the lateral dimension of the frame.

5. The rack of claim 4 wherein both the nonmovable engagers and the movable engagers extend beyond the principal width of the shelf.

6. The rack of claim 1 wherein each of the movable engagers rotate in separate substantially-parallel planes substantially orthogonal to the shelf plane.

7. The rack of claim 6 wherein the pair of movable engagers rotates simultaneously when the single-piece cross-member rotates.

8. The rack of claim 1 wherein:

the shelf has a plurality of lateral cross elements; and the single-piece cross-member is slidable within an adjustment region bounded by a first lateral cross member proximate the first end and a second lateral cross member between the first lateral cross member and the second end.

9. The rack of claim 8 wherein the adjustment region is about a quarter of the dimension between first and second ends of the shelf.

10. The rack of claim 9 wherein the angular adjustment of the shelf plane is allowed between about 0° and about 60° with respect to horizontal.

11. The rack of claim 1 wherein the single-piece cross-member includes an intermediate portion disposed below the shelf plane and extending therealong to support the shelf with respect to the frame, the intermediate portion defining the single axis.

12. The rack of claim 11 wherein each of the movable engagers includes a catch outward from the principal width rotatable about the single axis in a plane substantially orthogonal with respect to the shelf plane for engagement with a selected one of the apertures.

13. The rack of claim 12 wherein the catch rotation is limited to about 70°.

14. The rack of claim 1 wherein the angular adjustment of the shelf plane is allowed between about 0° and about 60° with respect to horizontal.

15. The rack of claim 1 wherein each upright element is a hollow tube.

16. The rack of claim 15 wherein each catch rests against an edge of the hollow tube defining the aperture.

17. The rack of claim 15 wherein each upright element is formed by at least two interconnected sections which are separable to minimize dimensions of the rack when disassembled.

18. The rack of claim 1 wherein each of the nonmovable engagers projects beyond the principal width and terminates in a catch for engagement with a selected one of the apertures.

* * * * *

UNITED STATES PATENT AND TRADEMARK OFFICE

CERTIFICATE OF CORRECTION

PATENT NO. : 9,004,300 B1
APPLICATION NO. : 14/084273
DATED : April 14, 2015
INVENTOR(S) : Jordan Morrell It is certified that error appears in the above-identified patent and that said Letters Patent is hereby corrected as shown below:

In the Specification

In column 1, line 27 delete “item” and insert --items--.
In column 1, line 35 delete “shelf” and insert --shelves--.
In column 1, line 40 delete “shelf” and insert --shelves--.
In column 3, line 58 between the words of and further insert --a--.
In column 4, line 56 after the word used delete “for.”.
In column 5, line 41 after the word and delete “a.”.
In column 5, line 48 after the word and delete “a.”.
In column 10, delete lines 1-10 and insert --Referring now to FIGS. 17-18, rotation of single-piece cross member 79 and of catch 89, 91 is limited in the examples by contact between outer cross members 63a, 63b and single-piece cross member 79 between second and third bends 113, 115. FIG. 18 shows such region of rotation of catch 89, 91 being limited to about 70° from vertical which is helpful to align catch 89, 91 with aperture 19 or 21 of each aperture pair 19, 21 for engagement with first upright elements 23a, 23b or second upright elements 25a, 25b.--.
In column 10, line 66 delete “pint” and insert --point--.

Signed and Sealed this
Twenty-fourth Day of November, 2015

Michelle K. Lee

Michelle K. Lee
*Director of the United States Patent and Trademark Office*